United States Patent [19]

Gute

[11] 4,019,004

[45] Apr. 19, 1977

[54] BUS DOOR SWITCH APPARATUS

[75] Inventor: Robert M. Gute, Corunna, Mich.

[73] Assignee: Midland-Ross Corporation, Cleveland, Ohio

[22] Filed: Sept. 5, 1975

[21] Appl. No.: 610,573

[52] U.S. Cl. ..... 200/61.43; 49/27

[51] Int. Cl.[2] ..... H01H 3/16; E05G 15/00

[58] Field of Search ..... 200/1 R, 1 A, 6 R, 6 A, 200/17 R, 61.41, 61.42, 61.43, 61.44, 276, 61.62; 49/27

[56] References Cited

UNITED STATES PATENTS

| | | | |
|---|---|---|---|
| 1,135,048 | 4/1915 | Pierman | 200/276 X |
| 2,135,131 | 11/1938 | Bassett | 200/61.43 |
| 3,193,628 | 7/1965 | Wanlass | 200/6 A |
| 3,210,496 | 10/1965 | Gary | 200/61.43 |

*Primary Examiner*—James R. Scott
*Attorney, Agent, or Firm*—Woodrow W. Portz

[57] ABSTRACT

Disclosed is a touch bar switch apparatus useful for the opening of bus doors and the like which may be included in an electro-pneumatic door-operating system of a vehicle. The apparatus includes an elongate touch bar and a pair of housings mounted for receiving the ends of the touch bar, and switch mechanism within at least one of the housings responsive to any lateral movement of the touch bar relative to a housing containing the switch mechanism wherein, as electrically-conductive switch terminals, an elongate, coil spring may warp laterally into contact with a normally concentric sleeve.

8 Claims, 2 Drawing Figures

BUS DOOR SWITCH APPARATUS

BACKGROUND OF THE INVENTION

In the operation of public transit services, it is desired to provide oneman operated buses or rail cars with passenger-operable door-opening controls at door of a vehicle remote from the operator's post. In known arrangements, the vehicle operator has within convenient reach a multi-position electro-pneumatic controller. This controller enables him simultaneously to render the vehicle incapable of movement and to either operate a remote door, or to place the electro-pneumatic door operating system of the vehicle in condition for enabling a passenger to open the door through bodily contact or by contact of articles carried by him with switching mechanism preferably mounted on the door. The door operating system is designed also to deprive the passenger of the option of opening the door when the vehicle is in motion. Such doors are commonly constructed in sections which part in the middle with the door-opening switching mechanism mounted along vertical meeting edges of the door sections. In the form herein contemplated, any such door-opening mechanism includes a vertically extending touch bar of which slight movement relative to the door actuates a switch for closing a door-opening circuit. Normally, the electro-pneumatic door opening system is arranged to operate on a cycle including door-shutting after a small time interval but to start a new cycle whenever the door-opening switching mechanism is engaged.

Objects of the invention are: to provide simple trouble-free touch-bar switching mechanism for activating electrically-operated door-mechanisms of any type of door; to provide such mechanism in a form easy to assemble and to mount on mass transit vehicle doors; to provide mechanism which is responsive to a light exterior force application from any lateral direction; and to provide mechanism of the foregoing objects in accordance with a simple design which can be manufactured at relatively low cost within this product field.

SUMMARY OF THE INVENTION

This invention is concerned with touch bar switching apparatus suitable for mounting on any type of support that usually is mounted on vehicle doors within a circuit of electro-pneumatic door closing mechanism. The invention is embodied in an apparatus comprising a touch bar, and first and second spaced assemblies which receive end portions of the touch bar. Each assembly comprises a housing for receiving an end portion of the touch bar, and at least either housing containing switch mechanism provides freedom for a small range of lateral movement of the bar in any direction. Either or both housings may contain a normally open electrical contact mechanism comprising basically an elongate, normally-rectilinear externally electrically-conductive flexible element, such as a coil spring, functioning as the terminal electrical connector entering the housing. Such flexible element is supported coaxially along the neutral axis of the touch bar and elements of the switching mechanism fixed within the housing. One end portion of the elements is secured within an end portion of the touch bar; the opposite end portion is secured within an electrically non-conducting portion of the housing. An electrically conductive sleeve, functioning as a terminal of another electrical conductor entering the housing, is fixed within the housing in concentric relation with the neutral axis and in radially spaced relation with the coil spring along an intermediate free portion of its length.

In one general aspect of the invention, a function of the housing is to support the touch bar in any manner which will maintain the capability of the switch contact elements which provide return of the touch bar to a neutral or centered position in the absence of lateral force thereagainst. In one form of the invention, at least one of the housings provides a recess having an annular bottom seating surface, normally of concave conical configuration mating with a convex conical end surface of the touch bar surrounding the coil spring. The concave surface has an axial aperture surrounding a coil spring of sufficient diameter to allow the touch bar to shift laterally to warp the spring end into contact with the sleeve. Lateral motion of the touch bar relative to the housing is limited by the diameter of the recess side wall.

DESCRIPTION OF PREFERRED EMBODIMENTS

Figure 1:
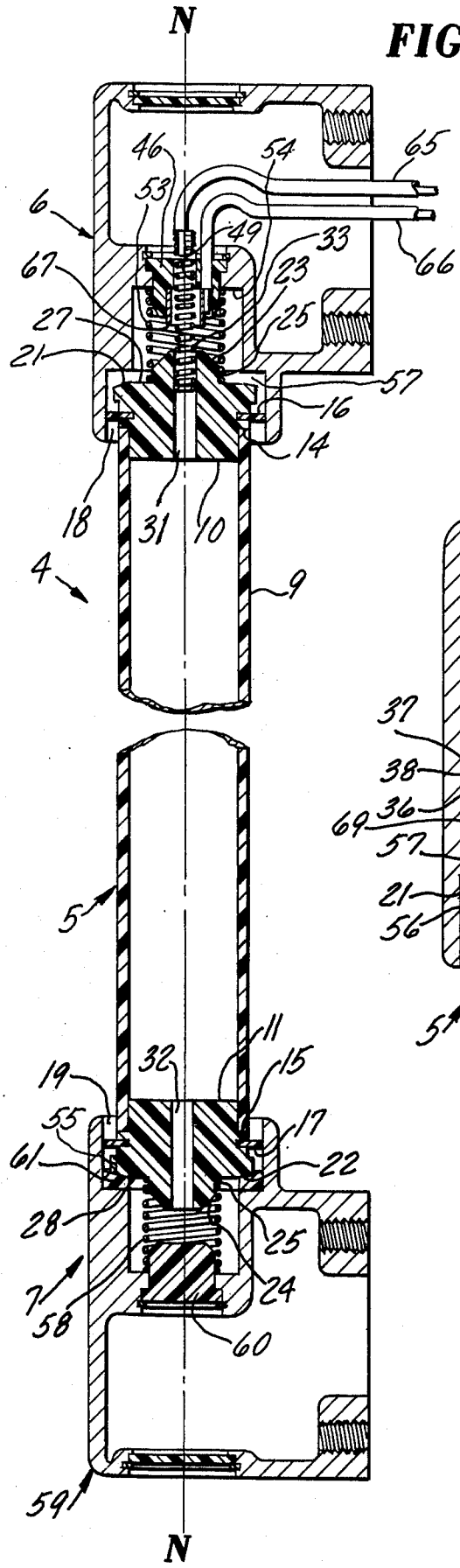
FIG. 1 is a vertical shortened cross section of the apparatus of the invention taken along its neutral axis N—N at neutral condition.

The touch bar switch apparatus 4 of the drawing comprises, in its major components, a touch bar 5, an upper assembly 6 which receives the upper end portion of the bar 5, and a lower assembly 7 which receives the lower end portion of the bar 5. As shown, the assemblies 6 and 7 have identical housings but the internal hardware thereof is different.

The bar 5 comprises a tube 9 shown with end plugs 10,11 of identical construction fixed to the tube. The plugs may be formed with swedged outer surfaces as shown, i.e., of two diameters providing shoulders 14,15, respectively, which engage the ends of the tubes 9 and thus assist in properly positioning the plugs relative to the length of the tube. The portions of the plugs extending beyond the tube are shown with annular grooves in which resilient washers 16,17 are received. These washers function as resilient buffers in restricting lateral movement of respective ends of the touch bar within the recesses 18,19 of the housings 6,7, respectively.

The plugs 10,11 are of similar contour rendering the ends of the touch bar 5 interchangeable with respect to the housings 6,7. As the bar 5 may be turned end-for-end, the plugs 10,11 have convex conical annular surfaces 21,22 facing in the outward axial direction of the touch bar for a reason which becomes apparent below. The plugs 10,11 are characterized by coaxial annular bosses 23,24 of which their outer peripheral circular surfaces 25,26 serve as spring aligning surfaces cooperating with spring seating surfaces 27,28. The plugs have central apertures 31,32 suitable for receiving the end portion of an electrically conductive elongate, normally rectilinear, coil spring 33. The boss 23 as shown in both figures is of substantially less diameter than the washer 57 to permit lateral movement of the touch bar 5 relative to the housing with the spring 33 in place. For the skilled mechanic, other elongate flexible electrically-conductive elements may be substituted for the coil spring 33.

Figure 2:
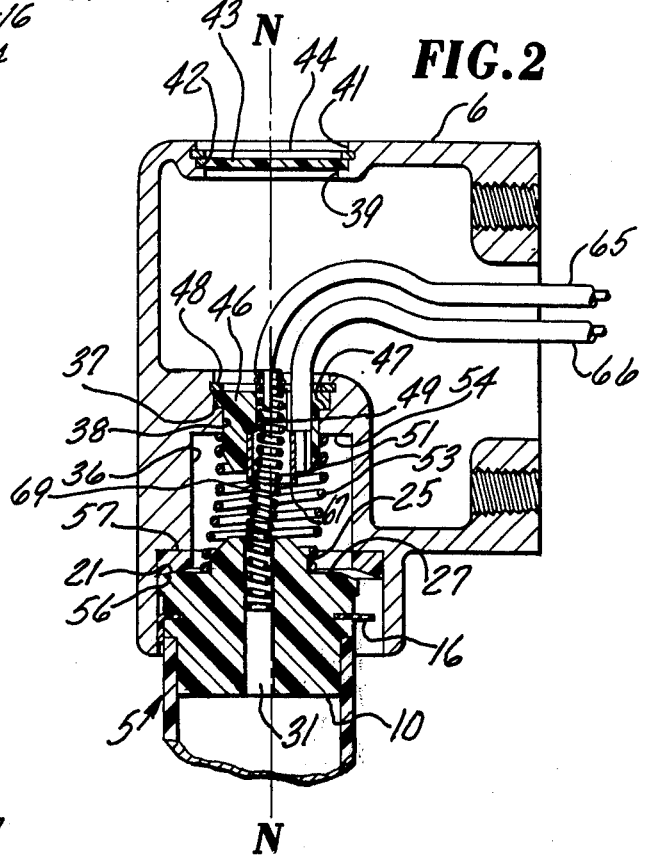
FIG. 2 is a fragmentary enlarged view in section of the upper portion of the apparatus of FIG. 1 showing the touch bar in a laterally displaced position with respect to the neutral axis N—N.

The apparatus as shown in FIG. 1 is coaxially aligned relative to a neutral axis N—N with respect to which the touch bar 5 may be thrust off center to the condition shown in FIG. 2. The apparatus is shown in FIG. 1 in its neutral condition with respect to neutral axis N—N. The recess 18 is a section of a passageway through the housing concentric with the axis N—N which has other counterbore sections of progressively less diameter at 36,37 and 38. An opening comprising surfaces 39,41 forming a shoulder 42 for a plug 43 is also coaxial with the axis N—N. Surface 41 is internally grooved for a retaining snap ring 44.

Surfaces 37,38 are complementary to the exterior surfaces of a mount plug 46 firmly seated on a shoulder 47 formed at the junction of surfaces 37,38. The plug is secured axially in place by a snap ring 48 received in an annular groove along the surface 37. The plug 46 has a central aperture 49 in which the end portion of the spring 33 is firmly secured. The opposite end portion of spring 33 is firmly secured to the plug 10 within the aperture 31. Plugs 46 and 10 are spaced to provide a free intermediate portion 51 of the spring which is free to deflect in a lateral direction as shown in FIG. 2 when the touch bar 5 is thrust sidewise into a lateral position with respect to the housing of assembly 6.

To return the touch bar to the position of FIG. 1 from the position of FIG. 2, the bar is assisted by the resilient washer 16, a spring 53 which engages the seating surface 27 and the aligning surface 25 of the plug 10, and the spring 33. The spring 53 is seated by its other end on housing seating surface 54. The spring 53, in exerting a laterally straightening force on the bar 5 is opposed by a spring 58 in housing 59 in assembly 7. The compressive strengths of springs 53 and 58 are selected to maintain engagement of the conically convex surface 22 of the bar 5 with the essentially complementary conically concave surface 55 of a washer 61. An axial gap 57 is to be noted within the recess 18 between the housing and the conical end surface 21 of the plug 11. Thus, the touch bar 5 is responsive to light lateral forces tending to actuate the switch mechanism within the assembly 6. The bar 5 may also freely rock or slide in a radial direction relative to the washer 61 as the result of its light pressure on the washer 61. A solid plug 60 similar in outer contour to plug 46 maintains the spring 58 in proper radial position.

The switch apparatus is also entirely operable by changing the switching of the washer 61 to the empty space 57 and leaving the space now shown occupied by the washer empty. In this event, the strengths of the springs 53 and 58 are revalued to support the touch-bar against washer 61 when occupying space 57.

An electrical conductor 65 extends into the housing into soldered connection with the spring 33. An electrical conductor 66 extends into soldered connection with a sleeve 67 which is received within a counterbore of the plug 46 substantially larger in diameter than the aperture 31 and is firmly fixed thereto as by cement. The sleeve 67 has a larger internal diameter than the outer diameter of the spring 33 to provide an annular clearance sufficient to necessitate lateral movement of the touch bar to close the clearance at any point surrounding the spring.

FIG. 2 illustrates the touch bar 5 sufficiently laterally displaced to cause the spring 33 to engage the sleeve at point 69 to thus close the circuit carried by connectors 65,66. To assure contact of the spring 33 with the sleeve 67, the annular spring seat surface and the housing surface 36 are in substantial exteriorly radially spaced relation with the sleeve 67 to permit adequate lateral movement of the touch bar.

As before indicated the entire switch apparatus may be provided with the switch mechanism of assembly 6 duplicated in assembly 7 with either assembly then being capable of circuit closing function to increase the sensitivity of the apparatus to touch-bar movement.

What is claimed is:

1. Manually operable normally open-circuit switch apparatus comprising a touch bar and first and second spaced assemblies to which opposite end portions of the bar are attached, said bar having at least one end portion comprising an electrically non-conductive material defining the end surface of the bar; said first assembly being adapted to receive two electrical conductors and comprising:

a housing providing a recess for receiving said end portion, said recess defined by an interior circular side wall surface having a radial clearance with said end portion;

a mount plug of electrically non-conductive material supported by said housing in axially spaced relation with said end portion; said plug and said end portion having central apertures and at inoperative position being aligned generally along a switch axis coaxial or parallel with the longitudinal axis of said bar;

an elongate laterally-flexible normally-rectilinear spring extending at least partly through said apertures with its exterior surface in tightly fitting relation with surfaces defining the apertures;

an electrically conductive sleeve supported in fixed position with said housing coaxially of said switch axis at a position between, and in spaced relation with, said end portion and the end of said mount plug further away from said end portion, said sleeve having an inner surface in normally radially spaced relation with said spring, and the length of said spring between said plug and said end portion being free to warp sidewise into contact with said sleeve;

said spring and said sleeve being adapted for separate connection with two conductors of an electrical circuit;

said second assembly adapted for mounting in fixed axially spaced relation with the first assembly and comprising means cooperating with means in the first assembly for maintaining said bar in a desired longitudinal or axial relation with said first assembly; and centering means urging said bar and said spring into coaxial relation with said sleeve.

2. The apparatus of claim 1 wherein, in providing said centering means and said means of the second assembly cooperating with means in the first assembly:

said second assembly comprises a housing having a recess for receiving the opposite end portion of said bar and the recess is defined by an interior circular sidewall surface having a radial clearance with said opposite end portion, and an annular bottom seating surface engaged by an end surface defined by said opposite end portion;

said first assembly comprises means acting in the longitudinal direction of the bar to urge said bar into engagement with said bottom seating surface;

said bottom seating surface having at least a portion thereof defining a concave conical area extending radially outwardly from its inner periphery; and said bar end surface comprises an annular generally conically convex area for engaging said concave conical area.

3. The apparatus of claim 2 comprising:

a washer received within said recess having an annular conically dished surface providing said concave area.

4. The apparatus of claim 1 wherein:

the sleeve is fixed to the end portion of said mount plug nearer the adjacent bar end portion and said end surface thereof is axially spaced from the sleeve.

5. The apparatus of claim 2 wherein:

said end portion of the bar comprises an end plug providing said end surface and aperture thereof;

said housing of the first assembly provides an annular spring seat surface in exteriorly concentrically spaced relation with said sleeve and axially spaced facing relation with an annular spring-seat surface defined by said end plug, said plug spring-seat surface being spaced radially inwardly from said recess-bottom seating surface; and said first assembly comprises a compression spring received between said spring-seat surfaces.

6. The apparatus of claim 2 wherein:

said first assembly comprises spring means acting on said touch bar in a direction toward said second assembly to exert greater thrust on said bar than opposing spring means in the second assembly to effect engagement of said concave area with said convex area.

7. The apparatus of claim 1 wherein:

said touch bar comprises an elongate tube and end plugs in each end of similar construction, each end plug defining said aperture and end surface of the bar;

said structure of the first assembly including said sleeve and said elongate spring is duplicated in said second assembly.

8. Manually operable normally open-circuit switch apparatus comprising a touch bar and first and second spaced assemblies to which opposite end portions of the bar are attached, said bar having at least one end portion comprising an electrically non-conductive material defining an end surface of the bar; said first assembly being adapted to receive two electrical conductors and comprising:

a housing providing a recess for receiving said end portion, said recess defined by an interior circular side wall surface having a radial clearance with said end portion;

an elongate, normally-rectilinear, externally electrically-conductive flexible element connected to one of said electrical conductors, said element having one of its end portions secured within said end surface of the touch bar and its opposite end portion secured within an electrically non-conducting portion of the housing, said element in neutral condition of the apparatus extending along a neutral axis of said touch bar and portions of the housing;

an electrically conductive sleeve connected to the other conductor supported in fixed position with said housing coaxially of said neutral axis at a position between, and in spaced relation with, said secured ends of the said element, said sleeve having an inner surface in radially spaced relation with said element at said neutral condition, and the length of said element between said secured ends being free to warp sidewise into contact with said sleeve when said touch bar is moved laterally; and centering means for urging said touch bar and said flexible element into coaxial relation with said sleeve.

* * * * *